United States Patent [19]

Loire

[11] 4,351,259

[45] Sep. 28, 1982

[54] SINGLE POINT MOORING AND DIRECTIONAL FENDER

[75] Inventor: René Loire, Houston, Tex.

[73] Assignee: Morrison-Knudsen Company, Inc., Boise, Id.

[21] Appl. No.: 146,609

[22] Filed: May 5, 1980

[51] Int. Cl.[3] ..... B63B 21/00

[52] U.S. Cl. ..... 114/230; 114/219; 405/212

[58] Field of Search ..... 114/230, 219, 220, 249; 405/211, 212-219; 9/8 P

[56] References Cited

U.S. PATENT DOCUMENTS

| | | | |
|---|---|---|---|
| 2,120,545 | 6/1938 | Buckton | 114/219 |
| 2,662,501 | 12/1953 | Bascome, Jr. | 114/230 |
| 2,912,953 | 11/1959 | Olsen | 114/230 |
| 2,915,879 | 12/1959 | Besse | 405/212 |
| 2,952,237 | 9/1960 | Reilly | 114/249 X |
| 3,008,599 | 11/1961 | Young, Jr. | 220/1 |
| 3,155,069 | 11/1964 | Ross et al. | 9/8 P X |
| 3,237,587 | 3/1966 | Ross | 114/230 |
| 3,403,431 | 10/1968 | Butler | 114/230 X |
| 3,426,542 | 2/1969 | Hindman et al. | 114/219 |
| 3,457,729 | 7/1969 | Wanneroy | 114/219 |
| 3,462,960 | 8/1969 | Bruehl | 114/219 |
| 3,464,214 | 9/1969 | King | 114/219 |
| 3,570,257 | 3/1971 | Walker et al. | 114/219 |
| 3,630,035 | 12/1971 | Wanneroy | 114/219 X |
| 3,675,610 | 7/1972 | Kohring | 114/230 |
| 3,783,816 | 1/1974 | Chassy et al. | 114/230 |
| 3,842,779 | 10/1974 | Jaynes | 114/230 |
| 3,901,040 | 8/1975 | Sandberg | 114/219 X |
| 3,938,462 | 2/1976 | Brandt | 114/230 |
| 4,098,211 | 7/1978 | Files et al. | 114/219 |
| 4,135,467 | 1/1979 | Loire et al. | 114/219 |

*Primary Examiner*—Sherman D. Basinger

*Attorney, Agent, or Firm*—Buell, Blenko, Ziesenheim & Beck

[57] ABSTRACT

The specification discloses a single point mooring and fender suitable for large ocean going vessels. A dolphin is embraced by two fender bars in crossing relationship and having at least one resilient yielding member to resist spreading.

7 Claims, 2 Drawing Figures

SINGLE POINT MOORING AND DIRECTIONAL FENDER

This invention relates to single point mooring of vessels. More particularly, it relates to the provision of fendering associated with mooring points at which large ocean going vessels are connected by a single point of attachment and are free to move about the mooring responsive to wind and current.

The increasing use of large tankers such as very large crude carriers and ultra-large crude carries has made use of piers and many existing harbors and channels impractical. For that reason it has become increasingly common to moor such vessels in deep water. A preferred type of mooring is a single point mooring around which the ship may swing under influence of wind and current. The ship is moored by approaching the mooring and tying on. Thereafter, hoses may be connected up for transfer of product to or from the ship.

Single point moorings may, for example, be in the form of a tower constructed of piling or a mono-tubular dolphin. For convenience, all such structures are referred to herein as a "dolphin". It is necessary to provide fendering to avoid damage to the mooring point by the ship's hull to protect the hoses and swivel joints from crushing between the ship and the mooring point and to absorb the kinetic energy of the ship should it approach the dolphin too closely.

Various types of fenders have heretofore been proposed. In one design a circular ring is provided surrounding the dolphin and an elastomeric material is interposed between them. Energy is absorbed by deformation of the elastomer. The design is large and heavy. The size of the fender makes it a larger target for the ship, and the weight inherent in the design makes it difficult for the fender to swing freely with the ship. In another design a circular tube is mounted upon steel spokes in a bicycle wheel arrangement. Under heavy load the spokes will be deformed or broken and must be replaced after hard contact by a ship's hull. The replacement of such consumable spokes is a distinct drawback and renders the mooring out of service for the period of repairs. Also, the size of a wheel required to provide a spoke of sufficient length to provide adequate deformation before failure produces a very large target for the ship.

I provide a single point mooring comprising a dophlin or the like, a pair of buoyant fender bars disposed in x-relationship with one bar passing on each side of the dolphin, yielding means extending from one fender bar around the dolphin to the other fender bar and yielding means extending between the two fender bars at one side of the dolphin. I prefer to provide tubular bars which float on the surface of the water and are arranged in an x-form with the point of cross-over adjacent the dolphin. I prefer to provide resilient yielding means attached to one of the fender bars on one side of the dolphin and extending around the dolphin and back to the other fender bar to urge the point of crossing of the fender bars toward the dolphin. I further prefer to provide resilient yielding means extending between the tips of the fender bars on the opposite side of the dolphin from the point of crossing of the fender bars. I may provide sails adjacent the ends of the fender bars opposite the ends connected by the yielding resilient means for response to wind and current.

In the accompanying drawings I have illustrated a present preferred embodiment of my invention in which.

Figure 1:
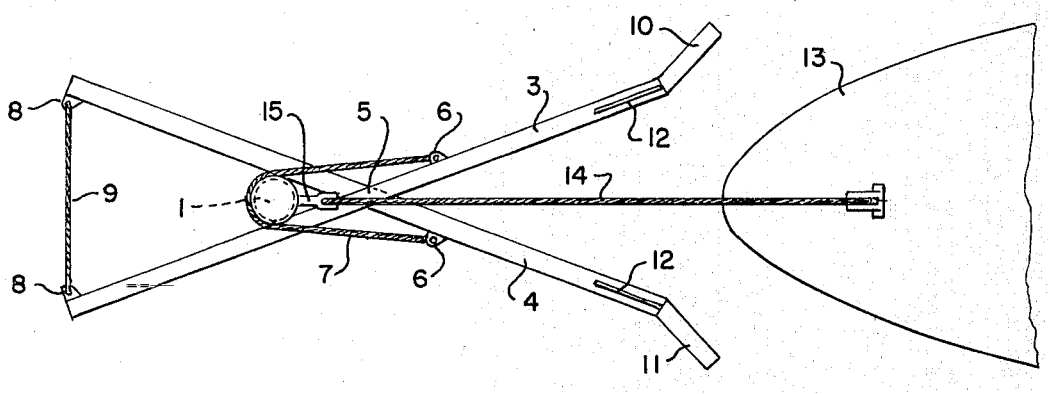
FIG. 1 is a plan view of a single point mooring embodying my invention.

Other details, objects and advantages of my invention will become more readily apparent as the following description of a present preferred embodiment thereof proceeds.

A single point mooring comprises a dolphin 1 which extends vertically through the surface 2 of a body of water. The dolphin may be a driven pile, or it may be attached to a sub-sea structure which maintains it in vertical position.

Fender bars 3 and 4 are positioned adjacent the dolphin in x-relationship, with the point of crossing being indicated at 5. Fender bars 3 and 4 are formed of hollow tubing and are buoyant. Pads 6 are welded onto fender bars 3 and 4 on the ship receiving side of crossing point 5. A nylon hawser extends from one of pads 6 around dolphin 1 and back to the other pad 6, thereby urging the point crossing of 5 of fender bars 3 and 4 toward dolphin 1. Pads 8 are welded to the ends of fender bars 3 and 4 at the ends opposite to the ship receiving end. A nylon hawser 9 connects between eyes in pads 8. The ends of fender bars 3 and 4 are turned outwardly at tips 10 and 11 to better ensure that bars 3 and 4 will embrace the hull of an approaching ship. Sails 12 are fitted on fender bars 3 and 4 adjacent to tips 10 and 11.

A portion of the hull of a ship 13 is shown approaching the mooring and is shown connected to the mooring by a hawser 14 connected to a mooring swivel 15 which is shown diagramatically.

Figure 2:
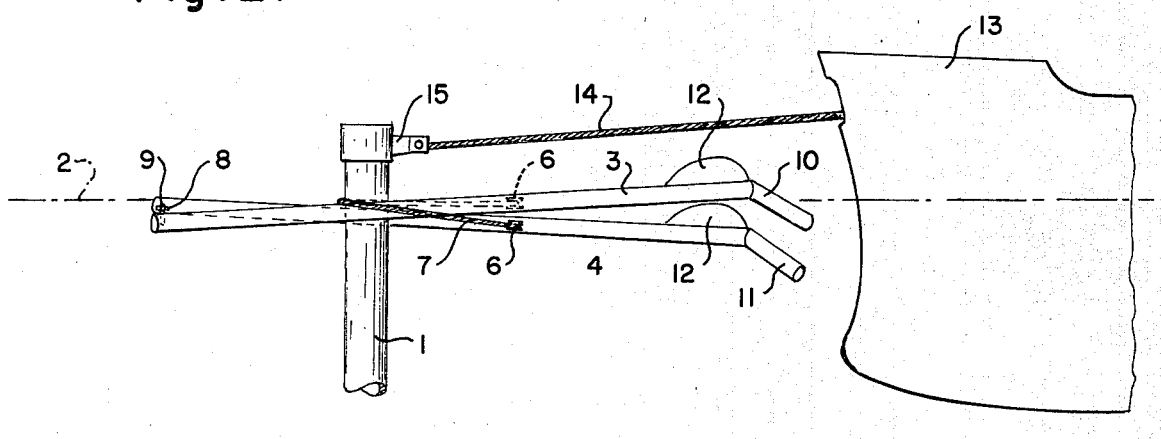
FIG. 2 is a side elevational view of the apparatus shown in FIG. 1.

In operation the fender bars are free to rise and fall with the tide. Sails 12 will cause them to swing with wind and current so that the fender bars will assume a position in which the two fender bars are generally aligned with a ship which is also swinging under influence of wind and current. When a ship is to be moored it approaches the mooring with the bow directed between tips 10 and 11 of the fender bars as shown in FIGS. 1 and 2. Closer approach to the dolphin will cause the hull to push outwardly against fender bars 3 and 4 as well as forcing them towards the dolphin. The forces will be transmitted on the dolphin as a fulcrum and will cause hawser 9 to be put under tension. As the tension increases the hawser's resistance to further deformation will likewise increase. The fender bars also will bend thereby absorbing additional energy in deformation of the bars.

Nylon hawsers have the property of substantial elongation without rupture. For example, an elongatiohn in the order of 30% may be expected at about 70% of breaking strength. Putting aside a permanent elongation, which takes place at the time of first pulling, the hawser may be expected to recover substantially its original length upon relaxation of the load.

Repair and replacement of the hawsers and fender bars may be carried out quickly and economically. The time during which the single point mooring is out of service is greatly reduced or eliminated.

While I have illustrated and described a present preferred embodiment of my invention it is to be understood that I do not limit myself thereto and that my invention may be otherwise variously practiced within the scope of the following claims.

I claim:

1. A single point mooring with a directional fender comprising a dolphin, a pair of buoyant fender bars floating in the water and crossing adjacent the dolphin, and extending beyond the dolphin on the side opposite to the point of crossing, said fender bars being in contact with the dolphin at least when a vessel is being restrained by the bars, said fender bars being freely rotatable relative to the dolphin and vertically movable with the tide relative to the dolphin, and resilient yielding means extending between the bars on the opposite side of the dolphin from the point of crossing and yieldingly resisting spreading apart of the points where the yielding means are attached to the fender bars.

2. A single point mooring set forth in claim 1 in which first resilient yielding means are connected to the fender bars on the same side of the dolphin as the point of crossing of the fender bars, one end of said resilient means being connected to one fender bar, said resilient means extending around the dolphin and the other end of said resilient means being connected to the other fender bar on the same side of the dolphin as said point of crossing.

3. A single point mooring as set forth in claim 2 in which the resilient yielding means comprise nylon mooring hawsers.

4. A single point mooring as set forth in claim 2 in which sails are fitted to the fender bars on the ends which extend from the dolphin through the point of crossing of the bars.

5. A single point mooring as set forth in claim 2 in which the ends of the fender bars which extend from the dolphin through the point of crossing of the bars are flared outwardly to better embrace the hull of an approaching ship between the fender bars.

6. A single point mooring as set forth in claim 1 in which the fender bars are restrained in proximity to the dolphin while allowing vertical and rotational movement of the fender bars relative to the dolphin.

7. A single point mooring comprising a dolphin, a pair of buoyant fender bars disposed in x relationship with one bar passing on each side of the dolphin and the fender bars crossing on one side of the dolphin, yielding means extending from one fender bar around the dolphin on the opposite side from the point of crossing to the other fender bar, said yielding means holding the fender bars in contact with the dolphin while permitting the bars to rotate relative to the dolphin and to rise and fall with the tide, and second yielding means extending between the fender bars on one side of the dolphin, said second yielding means being placed in tension by movement of a vessel toward the dolphin and between the fender bars on the opposite side of the dolphin from said second yielding means.

* * * * *